US009658555B2

(12) United States Patent
Hashimoto

(10) Patent No.: US 9,658,555 B2
(45) Date of Patent: May 23, 2017

(54) IMAGE FORMING APPARATUS HAVING A MOVING MECHANISM TO MOVE A DEVELOPING ROLLER TO A RETRACTED POSITION AND A TRANSMISSION MECHANISM TO CUT OFF TRANSMISSION TO THE DEVELOPING ROLLER

(71) Applicant: Brother Kogyo Kabushiki Kaisha, Nagoya-shi, Aichi-ken (JP)

(72) Inventor: Yohei Hashimoto, Nagakute (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/501,534

(22) Filed: Sep. 30, 2014

(65) Prior Publication Data

US 2015/0093152 A1 Apr. 2, 2015

(30) Foreign Application Priority Data

Sep. 30, 2013 (JP) ..... 2013-203749

(51) Int. Cl.
*G03G 15/01* (2006.01)
*G03G 15/08* (2006.01)
*G03G 21/16* (2006.01)

(52) U.S. Cl.
CPC ..... *G03G 15/0121* (2013.01); *G03G 15/0178* (2013.01); *G03G 15/0806* (2013.01);
(Continued)

(58) Field of Classification Search
CPC ..... G03G 15/0121; G03G 15/0178; G03G 21/1647; G03G 21/1676; G03G 15/0806
(Continued)

(56) References Cited

U.S. PATENT DOCUMENTS 7,778,569 B2 8/2010 Igarashi
8,041,255 B2 10/2011 Igarashi
(Continued)

FOREIGN PATENT DOCUMENTS

JP 2003-215876 A 7/2003
JP 2008-032916 A 2/2008
(Continued)

OTHER PUBLICATIONS

Dec. 13, 2016—(JP) Notice of Reasons for Rejection—App 2013-203749.

*Primary Examiner* — Walter L Lindsay, Jr.
*Assistant Examiner* — Philip Marcus T Fadul
(74) *Attorney, Agent, or Firm* — Banner & Witcoff, Ltd.

(57) ABSTRACT

An image forming apparatus includes first and second photosensitive drums, first and second developing rollers configured to supply developers to the first and second photosensitive drums, respectively, an electric motor configured to generate a driving force to rotate the second developing roller, a moving mechanism configured to move the second developing roller between a development position and a retracted position, a transmission mechanism configured to transmit the driving force to the second developing roller, a drive mechanism configured to drive the moving mechanism and the transmission mechanism simultaneously, and a connecting mechanism configured to, when the second developing roller is in the development position, bring the transmission mechanism into a transmission state that allows transmission of the driving force to the second developing roller, and to, when the second developing roller is in the retracted position, bring the transmission mechanism into a cut-off state the cuts off the transmission.

20 Claims, 6 Drawing Sheets

(52) U.S. Cl.
CPC ..... *G03G 21/1647* (2013.01); *G03G 21/1676* (2013.01); *G03G 15/0194* (2013.01); *G03G 2221/1657* (2013.01)

(58) Field of Classification Search
USPC ..... 399/228, 223
See application file for complete search history.

(56) References Cited

U.S. PATENT DOCUMENTS

| | | | | |
|---|---|---|---|---|
| 8,565,646 | B2 | 10/2013 | Suzuki | |
| 8,900,088 | B2 | 12/2014 | Yasuda et al. | |
| 2003/0138270 | A1 | 7/2003 | Matsuoka | |
| 2008/0025749 | A1* | 1/2008 | Igarashi | G03G 21/1647 399/92 |
| 2010/0266311 | A1 | 10/2010 | Igarashi | |
| 2011/0091237 | A1 | 4/2011 | Suzuki | |
| 2012/0251184 | A1 | 10/2012 | Hashimoto | |
| 2012/0275822 | A1* | 11/2012 | Kawamura | G03G 15/0121 399/111 |
| 2013/0084105 | A1* | 4/2013 | Suzuki | G03G 15/0121 399/228 |
| 2013/0101314 | A1 | 4/2013 | Yasuda et al. | |

FOREIGN PATENT DOCUMENTS

| | | | |
|---|---|---|---|
| JP | 2011-090040 | A | 5/2011 |
| JP | 2012-215603 | A | 11/2012 |
| JP | 2013-003227 | A | 1/2013 |
| JP | 2013-073221 | A | 4/2013 |
| JP | 2013-100896 | A | 5/2013 |

* cited by examiner

Fig.3A MONOCHROME PRINTING

Fig.3B COLOR PRINTING

Fig.5A
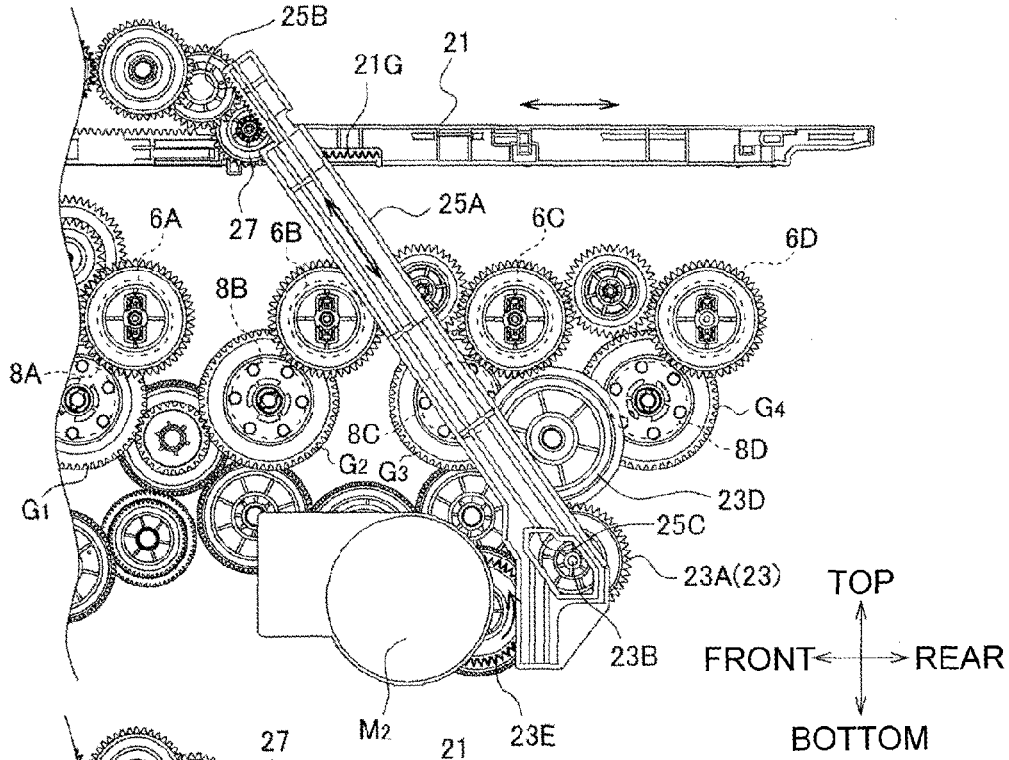
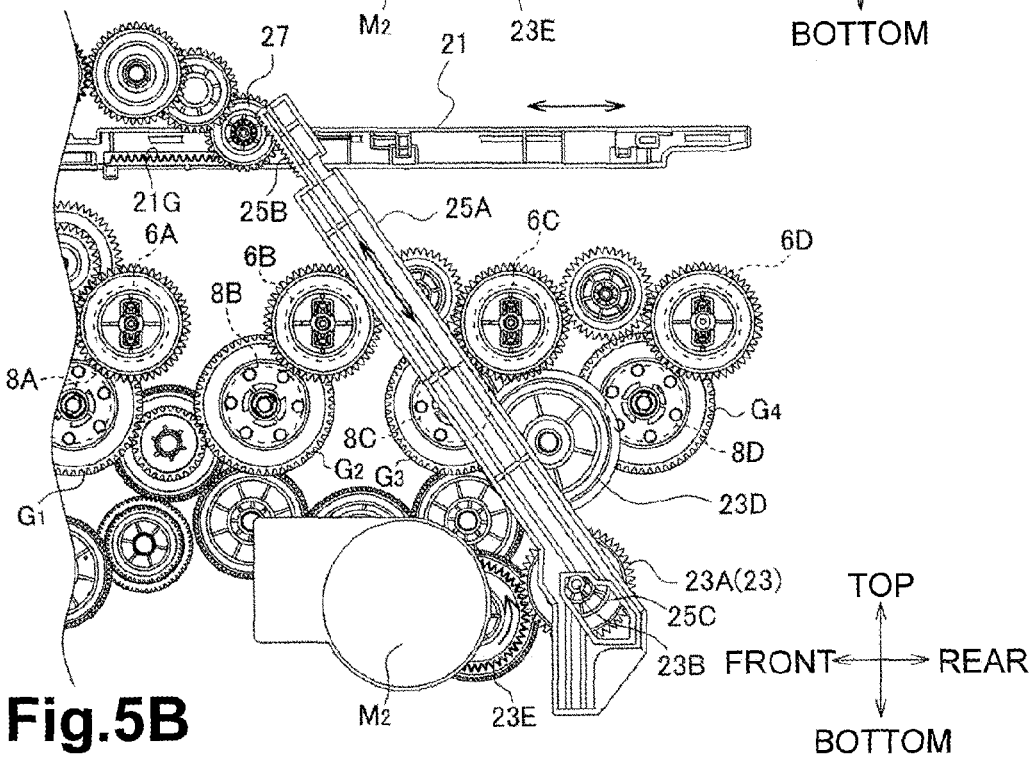
Fig.5B

IMAGE FORMING APPARATUS HAVING A MOVING MECHANISM TO MOVE A DEVELOPING ROLLER TO A RETRACTED POSITION AND A TRANSMISSION MECHANISM TO CUT OFF TRANSMISSION TO THE DEVELOPING ROLLER

CROSS REFERENCE TO RELATED APPLICATION

This application claims priority from Japanese Patent Application No. 2013-203749, filed on Sep. 30, 2013, which is incorporated herein by reference in its entirety.

TECHNICAL FIELD

Aspects of the disclosure relate to an image forming apparatus configured to form an image on a sheet.

BACKGROUND

Some image forming apparatuses are capable of switching between a monochrome printing mode and a color printing mode.

One of the image forming apparatuses includes a moving mechanism that moves a developing device, such as a developing cartridge, and a clutch mechanism that cuts off transmission of driving force to the developing device. Moreover, the moving mechanism and the clutch mechanism are both disposed below a photosensitive drum.

SUMMARY

However, when the moving mechanism and the clutch mechanism are both disposed below the photosensitive drum, the degree of flexibility in design becomes small and, accordingly, design development may be hindered.

In view of the above points, an object of the disclosure is to, as regards an image forming apparatus that is capable of switching between a monochrome printing mode and a color printing mode, provide a configuration to increase the degree of flexibility in design.

According to an aspect of the disclosure, an image forming apparatus may include a first photosensitive drum having a rotation axis and configured to carry a developer image thereon, a second photosensitive drum having a rotation axis parallel to the rotation axis of the first photosensitive drum and configured to carry a developer image thereon, a first developing roller configured to supply a first developer to the first photosensitive drum, a second developing roller configured to supply a second developer to the second photosensitive drum. The second developing roller is configured to move between a development position in which the second developing roller supplies the second developer to the second photosensitive drum and a retracted position in which the second developing roller stops supplying the second developer to the second photosensitive drum. The image forming apparatus includes an electric motor configured to generate a driving force to cause the second developing roller to rotate, a moving mechanism, a transmission mechanism, a drive mechanism, and a connecting mechanism. The moving mechanism is disposed on a same side as a rotation axis of the second developing roller relative to a plane including the axis of the first photosensitive drum and the axis of the second photosensitive drum and is configured to move the second developing roller between the development position and the retracted position. The transmission mechanism is disposed on an opposite side to the rotation axis of the second developing roller relative to the plane. The transmission mechanism is configured to transmit the driving force to the second developing roller. The transmission mechanism is configured to change between a transmission state that allows transmission of the driving force to the second developing roller and a cut-off state that cuts off transmission of the driving force to the second developing roller. The drive mechanism is configured to drive the moving mechanism and the transmission mechanism simultaneously. The connecting mechanism is configured to connect the moving mechanism and the transmission mechanism. The connecting mechanism is configured to, when the second developing roller is in the development position, bring the transmission mechanism into the transmission state. The connecting mechanism is configured to, when the second developing roller is in the retracted position, bring the transmission mechanism into the cut-off state.

Thus, the moving mechanism and the transmission mechanism are spaced apart from each other relative to the plane including the axis of the first photosensitive drum and the axis of the second photosensitive drum.

BRIEF DESCRIPTION OF THE DRAWINGS

For a more complete understanding of the present disclosure, needs satisfied thereby, and the objects, features, and advantages thereof, reference now is made to the following description taken in connection with the accompanying drawings.

FIGS. 5A and 5B are diagrams illustrating an operation of a connection member of a connecting mechanism.

DETAILED DESCRIPTION

Figure 1:
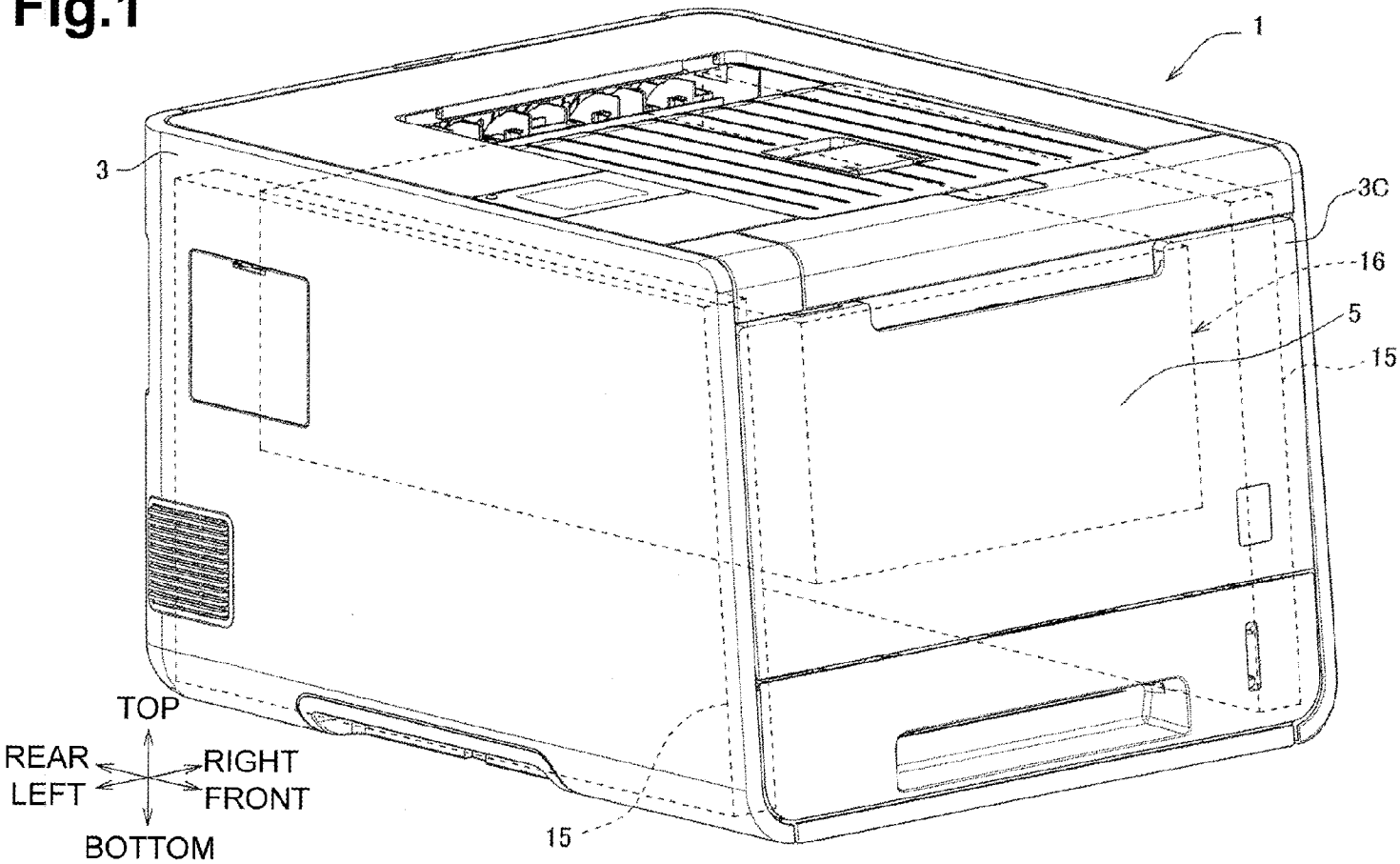
FIG. 1 is an external perspective view of an image forming apparatus according to an embodiment of the disclosure.

An illustrative embodiment of the disclosure is described below. It should be understood that features of the disclosure as presented in the claims are not intended to be limited by the means and structures set forth in the following embodiment.

According to the illustrative embodiment, the disclosure is applied to an electrophotographic image forming apparatus. Arrows indicating directions in each of drawings are indicated to facilitate the understanding of positional relationships among the drawings. As regards the number of components and parts described with reference numerals, at least one is provided unless "plural" or "two or more" is specifically stated otherwise. Hereinafter, the illustrative embodiment of the disclosure will be described together with the drawings.

Figure 2:
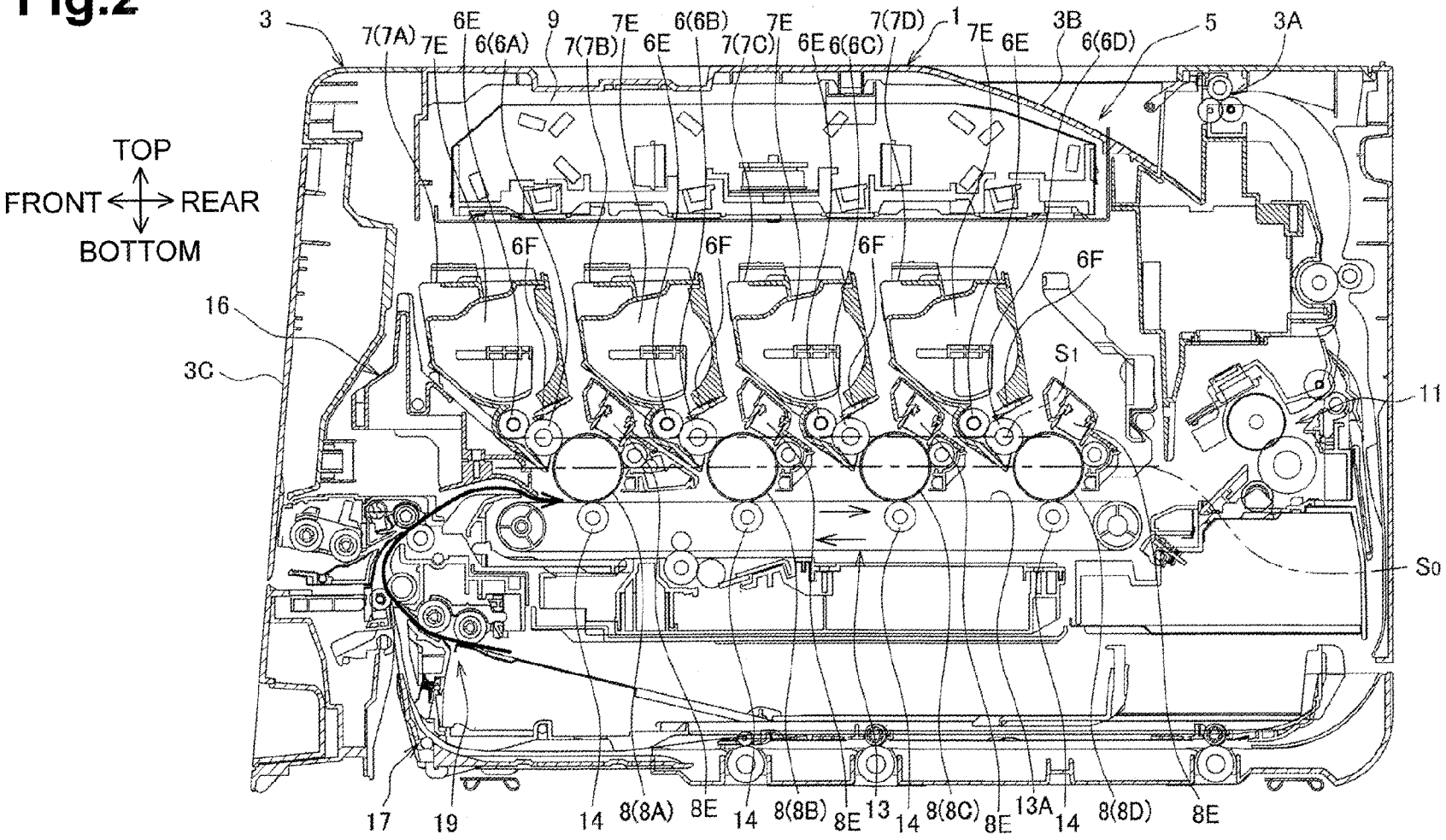
FIG. 2 is a central cross-sectional view of the image forming apparatus according to the embodiment of the invention.

As illustrated in FIG. 1, an image forming apparatus 1 accommodates, inside a housing 3, an electrophotographic image forming unit 5 configured to form an image on a sheet such as paper. As illustrated in FIG. 2, the image forming unit 5 includes a plurality of developing cartridges 7, a plurality of photosensitive drums 8, a plurality of chargers 8E, an exposure unit 9, and a fixing unit 11.

The developing cartridges 7 include respective developer storage portions 7E and respective developing rollers 6. The developer storage portions 7E store respective developers of black, yellow, magenta, and cyan, in this order, in a direction from one end (the front in the present embodiment) toward the other end (the rear in the present embodiment) of an arrangement of the developing cartridges 7.

A relevant developer is supplied to each developing roller 6 through a corresponding supply roller 6E that is disposed at a corresponding position. Of the developer that has been supplied to the developing roller 6, unneeded developer is scraped off by a thin plate-shaped blade 6F that is in contact with an outer peripheral surface of the developing roller 6.

The photosensitive drums 8 and the chargers 8E are provided in equal numbers to the developing cartridges 7. The photosensitive drums 8 are each configured to rotate about a rotation axis. The rotation axes of the photosensitive drums 8 are parallel to one another. Accordingly, the rotation axes of the photosensitive drums 8 are included in a plane S0.

The developing rollers 6 are each configured to rotate about a rotation axis. The rotation axes of the developing rollers 6 are also parallel to one another, and the rotation axes of the developing rollers 6 are included in a second plane S1 that is parallel to the plane S0. The second plane S1 is defined when each developing roller 6 and the corresponding photosensitive drum 8 are in contact with each other.

Each of the chargers 8E charges a corresponding one of the photosensitive drums 8 disposed at a corresponding position. The exposure unit 9 exposes each of the charged photosensitive drums 8. An electrostatic latent image is formed on each of the exposed photosensitive drums 8. When a developer is supplied from each of the developing rollers 6 to a corresponding one of the photosensitive drums 8 on which an electrostatic latent image has been formed, a developer image according to the relevant electrostatic latent image is carried on the outer peripheral surface of each photosensitive drum 8.

A belt 13 is a band-like endless belt, and transports a sheet that is placed on a stretched surface 13A in the direction from one end toward the other end of the arrangement of the developing cartridges 7 described above. The stretched surface 13A is a surface of the belt 13 that faces the photosensitive drums 8. The belt 13 is disposed across the plane S0 from the rotation axes of the developing rollers 6, in other words, the belt 13 is disposed below the plurality of photosensitive drums 8.

Transfer bodies 14 are disposed at positions facing the respective photosensitive drums 8 while pinching the stretched surface 13A together with the photosensitive drums 8. Each of the transfer bodies 14 transfers the developer image carried by the corresponding photosensitive drum 8 onto the sheet. Accordingly, the developer images that are carried by the photosensitive drums 8 are each transferred to the sheet in a superimposed manner.

The fixing unit 11 applies pressure and heat to the developer that has been transferred to the sheet, and accordingly, the developer image is fixed to the sheet. The sheet on which the image has been formed is received on an ejection tray 3B, which is provided on the housing 3, with an ejection roller 3A.

A feeder mechanism 19 is provided upstream of the belt 13 in the sheet transport direction. The feeder mechanism 19 feeds the sheets received on a sheet supply tray 17 one by one towards the image forming unit 5. The sheet supply tray 17 is a receiving portion capable of receiving a plurality of sheets. The sheet supply tray 17 is inserted into and mounted in a main body (the housing 3) in a detachable manner.

As illustrated in FIG. 1, the main body refers to the housing 3 and main frames 15, which are, during normal time of usage, not disassembled or dismounted by the user. The main frames 15 are substantially plate-shaped strength members that are disposed on respective sides of the image forming unit 5 in the horizontal direction. The housing 3 is constituted by external covers that cover the main frames 15 from the outside.

In the present embodiment, as illustrated in FIG. 2, the developing cartridges 7 and photosensitive drums 8 are mounted on a drawer 16. The drawer 16 is movable relative to the main frames 15 in the arrangement direction (the front-rear direction in the present embodiment). Moreover, by opening a front cover 3C provided in the housing 3, the user can pull out the drawer 16 from inside the housing 3 to the outside.

Hereinafter, the developing cartridge 7 for black is referred to as a first developing cartridge 7A, the developing roller 6 for black is referred to as a first developing roller 6A, and a photosensitive drum 8 for black is referred to as a first photosensitive drum 8A. Similarly, the developing cartridge 7 for yellow is referred to as a second developing cartridge 7B, the developing roller 6 for yellow is referred to as a second developing roller 6B, and a photosensitive drum 8 for yellow is referred to as a second photosensitive drum 8B.

The developing cartridge 7 for magenta is referred to as a third developing cartridge 7C, and the developing roller 6 for magenta is referred to as a third developing roller 6C, and the photosensitive drum 8 for magenta is referred to as a third photosensitive drum 8C. The developing cartridge 7 for cyan is referred to as a fourth developing cartridge 7D, and the developing roller 6 for cyan is referred to as a fourth developing roller 6D, and a photosensitive drum 8 for cyan is referred to as a fourth photosensitive drum 8D.

Moreover, the image forming apparatus 1 according to the present embodiment is capable of switching between monochrome printing, which carries out image forming using a developer with a specific color developer alone (black in the present embodiment), and color printing, which carries out image forming using a plurality of developers.

Figure 3:
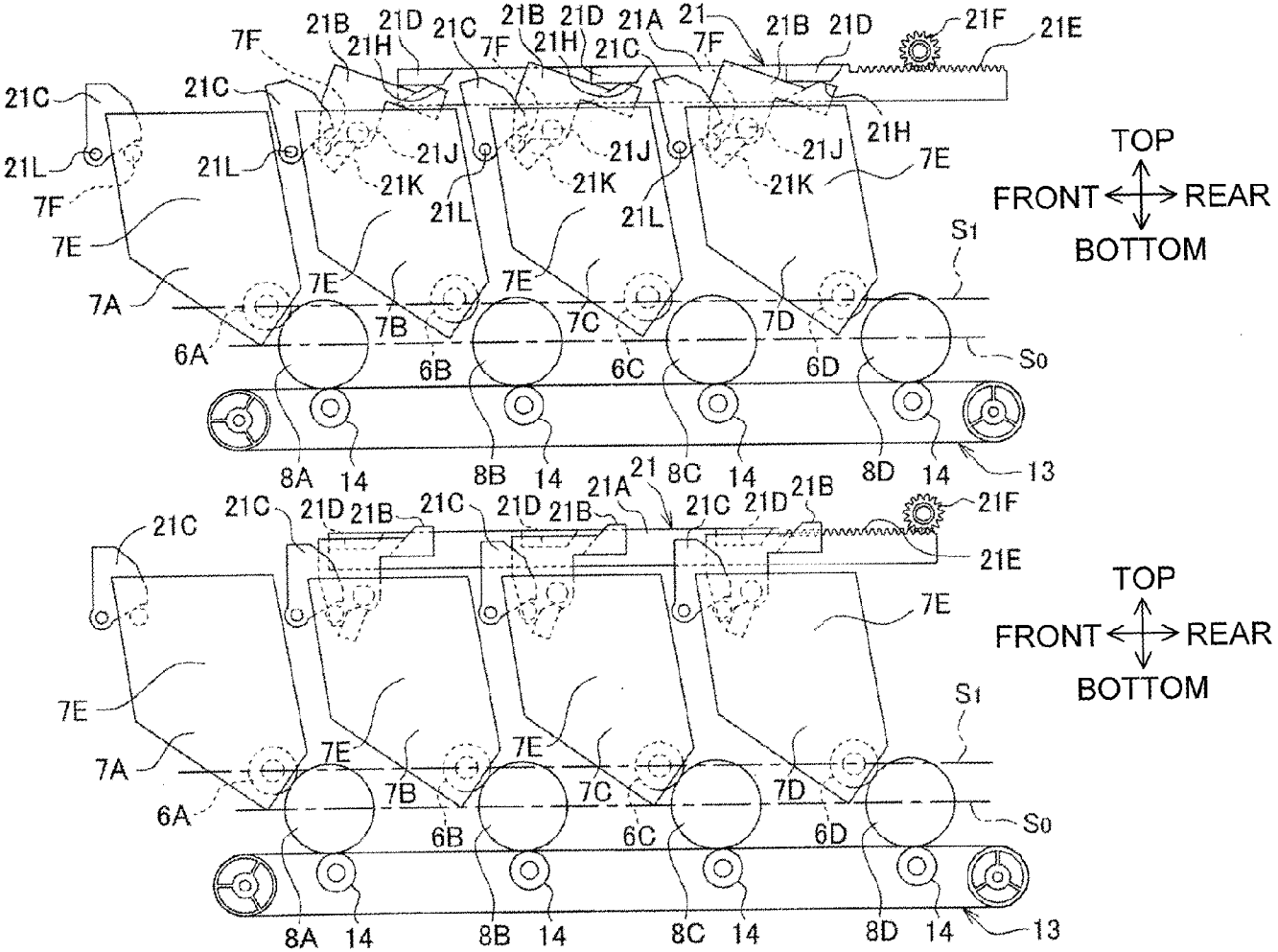
FIGS. 3A and 3B are diagrams illustrating an operation of a direct action member of a moving mechanism.

As illustrated in FIG. 3A, during monochrome printing, the first developing roller 6A and the first photosensitive drum 8A are in contact with each other, the developing rollers 6B to 6D other than the first developing roller 6A are separated from the photosensitive drums 8B to 8D, respectively, and transmission of driving force to the developing rollers 6B to 6D is cut off.

Thus, the second developing roller 6B, the third developing roller 6C, and the fourth developing roller 6D stop supplying developers to the respective photosensitive drums 8B to 8D, and the second developing roller 6B, the third developing roller, the fourth developing roller 6D and the respective supply rollers 6E stop rotating such that only a monochrome developer can be supplied to the photosensitive drum 8A. Even during monochrome printing, all of the photosensitive drums 8 rotate. Hereinafter, a position of a developing roller 6 stopping supplying the developer to a corresponding photosensitive drum 8 is referred to as a retracted position.

As illustrated in FIG. 3B, during color printing, the developing rollers 6 (all in the present embodiment) that supply developers needed during color printing are in contact with the respective photosensitive drums 8, and the developing rollers 6, the supply rollers 6E, and the photosensitive drums 8 rotate. Accordingly, all of the photosensitive drums 8 can be supplied with their respective developers. Hereinafter, a position of a developing roller 6 that allows the developer to be supplied to the corresponding photosensitive drum 8 is referred to as a development position.

In other words, the second developing roller 6B to the fourth developing roller 6D (hereinafter, also referred to as the second to fourth developing rollers 6B to 6D) according to the present embodiment are movable between the retracted positions and the development positions. Moreover, when the second to fourth developing rollers 6B to 6D are in the retracted positions, monochrome printing can be performed. When the second to fourth developing rollers 6B to 6D are in the development positions, color printing can be performed.

As illustrated in FIGS. 3A and 3B, a moving mechanism 21 moves the second to fourth developing rollers 6B to 6D between the development positions and the retracted positions. The moving mechanism 21 is disposed on the same side as the second plane S1 relative to the plane S0. Moreover, the developer storage portions 7E are disposed between the moving mechanism 21 and the first photosensitive drum 8A to the fourth photosensitive drum 8D.

The moving mechanism 21 includes a direct action member 21A, a plurality of, e.g., three, separation cams 21B, and a plurality of, e.g., three, return cams 21C. The direct action member 21A is a member that is movable in a direction parallel to the direction in which the photosensitive drums 8 are arranged. The direct action member 21A includes the cam portions 21D that move the separation cams 21B.

Each separation cam 21B is disposed at a position shifted from the corresponding developing cartridge 7 in a direction of the rotation axis. A portion of each separation cam 21B that has been projected on a plane that is orthogonal to the direction of the rotation axis overlaps the corresponding developer storage portion 7E that has been projected on the plane.

Each separation cam 21B includes a shaft portion 21J, a pushed portion 21H, and a working portion 21K. Each separation cam 21B is coupled to the drawer 16 such that it is pivotable about the corresponding shaft portion 21J. Each pushed portion 21H receives a pushing force from the corresponding cam portion 21D. Each working portion 21K moves the corresponding developing cartridge 7. Each developing cartridge 7 includes a protrusion 7F that protrudes in the direction of the rotation axis.

As illustrated in FIG. 3A, when the direct action member 21A moves rearward, each pushed portion 21H receives a pushing force from the corresponding cam portion 21D and is pushed downwards, and accordingly, each of the separation cams 21B pivots clockwise about the corresponding shaft portion 21J.

Furthermore, each working portion 21K lifts up the corresponding protrusion 7F, and accordingly, the developing cartridges 7B to 7D that include therein the second to fourth developing rollers 6B to 6D, respectively, move relative to the respective photosensitive drums 8B to 8D. Thus, the second to fourth developing rollers 6B to 6D are separated from the second to fourth photosensitive drums 8B to 8D and located in the retracted positions.

Each return cam 21C is connected to the drawer 16 in a pivotal manner through a corresponding shaft portion 21L. Furthermore, each return cam 21C receives elastic force from a spring (not shown) and constantly presses the protrusion 7F of the corresponding developing cartridge 7 towards the corresponding photosensitive drum 8. As illustrated in FIG. 3B, when the direct action member 21A moves frontward and each cam portion 21D is separated from the corresponding separation cam 21B, the developing cartridges 7B to 7D that include therein the second to fourth developing rollers 6B to 6D, respectively, move toward the respective photosensitive drums 8B to 8D. Thus, the second to fourth developing rollers 6B to 6D are brought into contact with the second to fourth photosensitive drums 8B to 8D, respectively, and located in the development positions. In the development positions, each working portion 21K is not in contact with the corresponding protrusion 7F.

The direct action member 21A, the separation cams 21B, and the return cams 21C are provided on either side of the image forming apparatus 1 in the direction of the rotation axis, that is, the direct action member 21A, the separation cams 21B, the return cams 21C, and the like are provided on each of the left and right sides of the image forming apparatus 1. The left and right direct action members 21A are each provided with a first rack 21E on one end portion thereof in the longitudinal direction.

Each direct action member 21A is disposed above the developing cartridges 7B to 7D. The direct action members 21A and the developing cartridges 7B to 7D are disposed so that, when the direct action members 21A and the developing cartridges 7B to 7D are projected on a plane that is orthogonal to the direction of the rotation axis, they do not overlap one another on the plane. Accordingly, when the drawer 16 is moved in the front-rear direction, the direct action members 21A and the drawer 16 do not interfere with each other. With this structure, the developing cartridges 7 can be removed from the main body easily.

Each first rack 21E is provided with a first pinion 21F that meshes with the first rack 21E. Furthermore, the left and right first pinions 21F are connected to each other through a shaft (not shown). Accordingly, the left and right direct action members 21A are mechanically interlocked with each other and move parallel to each other.

Figure 4:
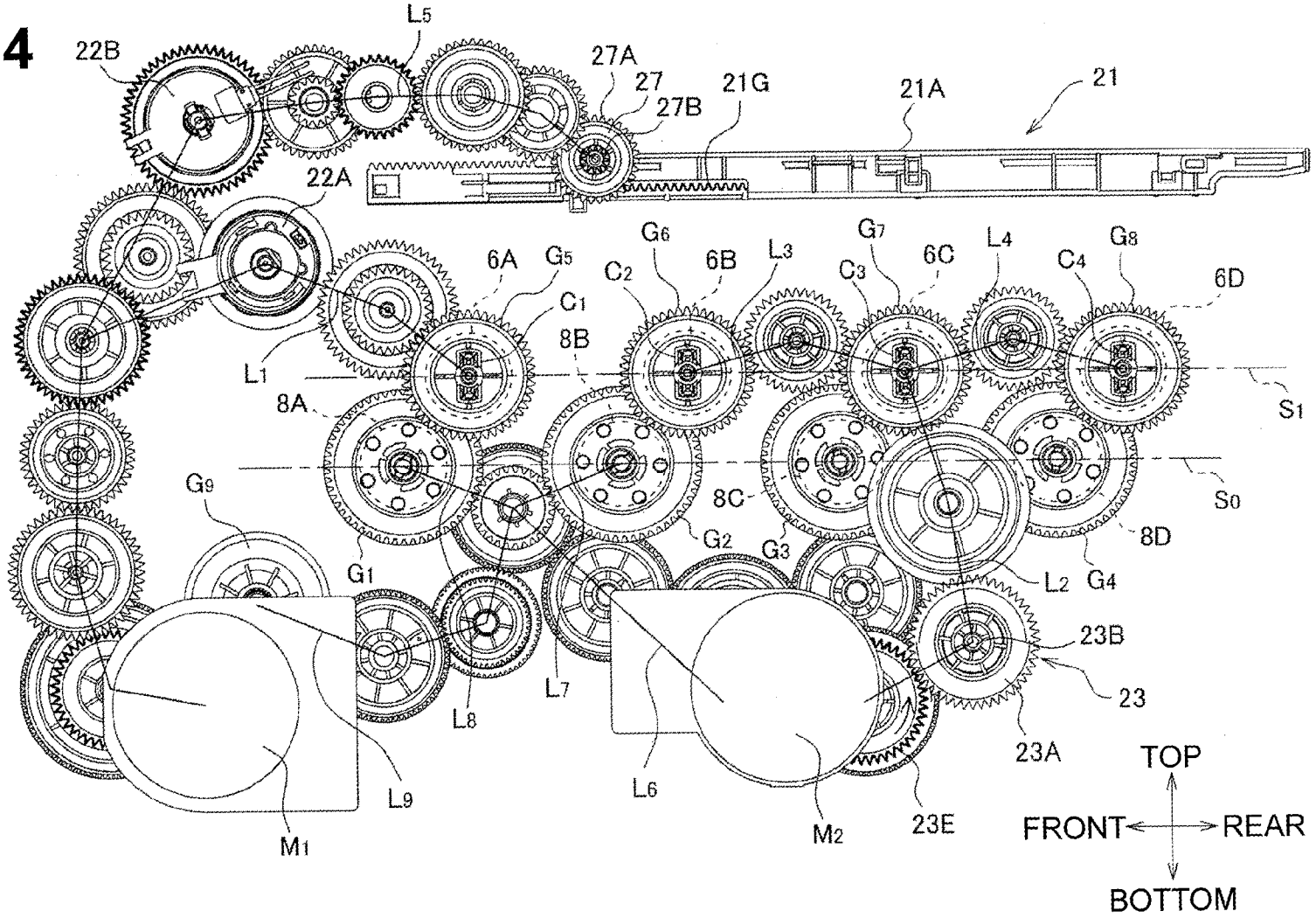
FIG. 4 is a diagram illustrating transmission routes of driving force in the image forming apparatus according to the embodiment of the disclosure.

In the present embodiment, as illustrated in FIG. 4, a first electric motor M1 and a second electric motor M2 are disposed on the same side as the belt 13 relative to the plane S0. Driving force generated by the first electric motor M1 is transmitted to at least a gear G5 that rotates the first developing roller 6A. The gear G5 includes a coupling C1 that engages with the first developing roller 6A to transmit a rotational force thereto.

A transmission route L1 along which the first electric motor M1 transmits a driving force to the first developing roller 6A is determined by a plurality of gears. A first clutch 22A that interrupts transmission of driving force to the first developing roller 6A is provided in the transmission route L1. The first clutch 22A is a solenoid operated interrupter.

The second electric motor M2 generates driving force that rotates at least the second to fourth developing rollers 6B to 6D. Transmission routes L2 to L4 along which the second electric motor M2 transmits a driving force to the gears G6 to G8 that rotate the second to fourth developing rollers 6B to 6D, respectively are determined by a plurality of gears.

Driving force from the second electric motor M2 is transmitted, through the transmission route L2, to the gear G7, which rotates the third developing roller 6C. Driving force from the second electric motor M2 is transmitted, through the transmission routes L2 and L3, to the gear G6, which rotates the second developing roller 6B. Driving force from the second electric motor M2 is transmitted, through the transmission routes L2 and L4 to the gear G8, which rotates the fourth developing roller 6D.

In the development positions, the rotation axes of the second to fourth developing rollers 6B to 6D and the rotation axes of the gears G6 to G8, respectively, coincide with each other. The gears G6 to G8 include couplings C2 to C4, respectively, which engage with the second to fourth developing rollers 6B to 6D, respectively, to transmit rotational force thereto. The couplings C2 to C4 are known universal couplings, and maintain engagement with the second to fourth developing rollers 6B to 6D, respectively, even when the second to fourth developing rollers 6B to 6D are in the retracted positions.

A transmission mechanism 23 is provided in a portion of the transmission route L2, which is opposite to the second plane S1 relative to the plane S0, in other words, the transmission mechanism 23 is provided in a portion of the transmission route L2, which is below the plane S0. The transmission mechanism 23 switches the state of the transmission route L2 between a transmission state that allows transmission of driving force to the second to fourth developing rollers 6B to 6D and a cut-off state that cuts off transmission of driving force thereto.

In other words, as illustrated in FIGS. 5A and 5(B), the transmission mechanism 23 includes a gear 23A having a rotating shaft 23B that is movable. As illustrated in FIG. 6B, the rotating shaft 23B is supported by a long-hole shaped bearing portion 23C that is provided in the main frame 15.

The bearing portion 23C is a slide bearing. The rotating shaft 23B slidingly moves inside the bearing portion 23C in the major axis direction of the bearing portion 23C such that the gear 23A moves between a position in which the gear 23A meshes with an output gear 23D (see FIG. 5A) that transmits driving force to the second to fourth developing rollers 6B to 6D and a position in which the gear 23A is separated from the output gear 23D.

The gear 23A is in constant mesh with a sun gear 23E (see FIGS. 5A and 5B) and receives driving force from the sun gear 23E. Furthermore, when the gear 23A is not receiving any force from a connection member 25A described later, in other words, as illustrated in FIG. 6B, when the rotating shaft 23B and a bearing portion 25C of the connection member 25A is not in contact with each other, the gear 23A rotates with the rotational force received from the sun gear 23E while being meshed with the output gear 23D (see FIG. 5A).

Figure 6A:
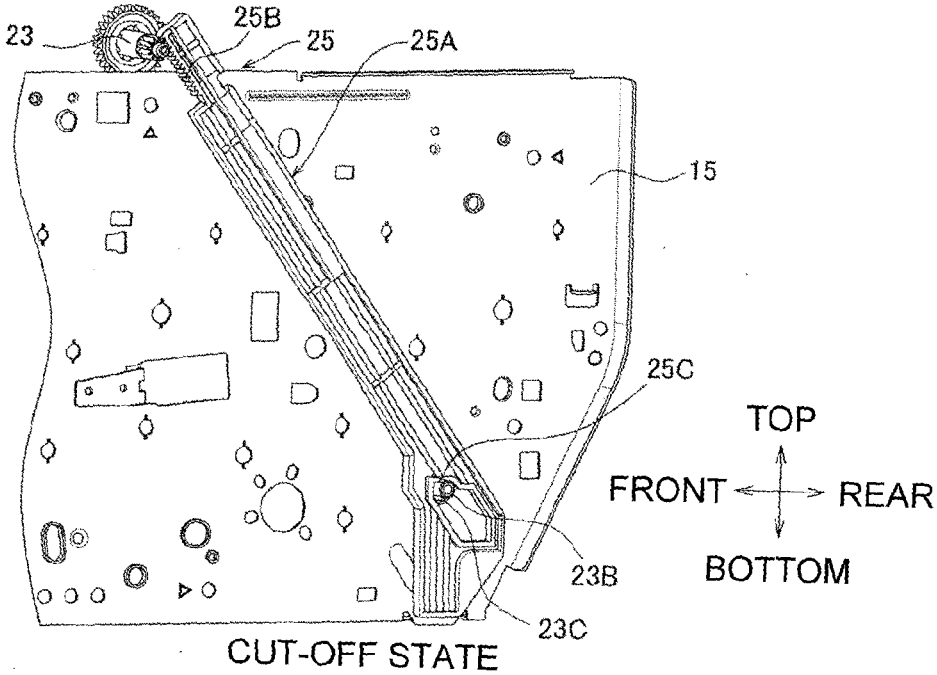
FIGS. 6A and 6B are perspective views illustrating the operation of the connection member of the connecting mechanism.
Figure 6B:
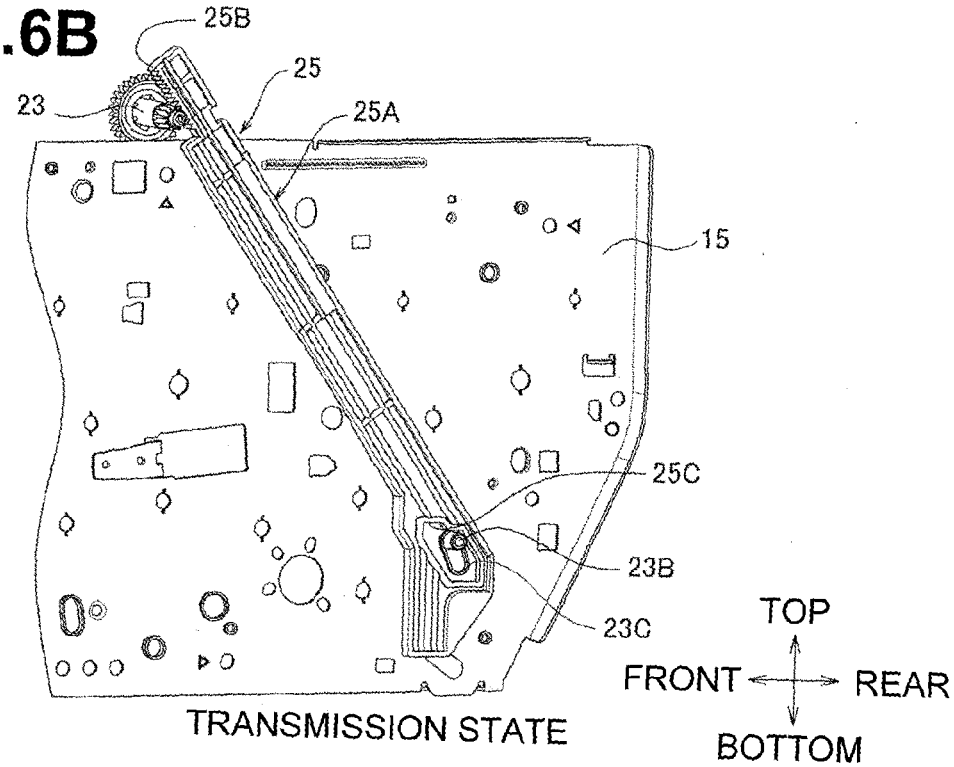

As illustrated in FIG. 6A, when the rotating shaft 23B and the connection member 25A are in contact with each other, the rotating shaft 23B receives force from the connection member 25A. Thus, the gear 23A is separated from the output gear 23D and, accordingly, the transmission of driving force is cut off (see FIG. 5B). In other words, the gear 23A moves between the transmission state and the cut-off state.

As illustrated in FIG. 4, driving force that has been generated in the second electric motor M2 is also supplied to the gears G1 to G4 that rotate the first photosensitive drum 8A to the fourth photosensitive drum 8D, respectively, and to the gear G9 that rotates the belt 13. The rotation axes of the first photosensitive drum 8A to the fourth photosensitive drum 8D and the rotation axes of the gears G1 to G4, respectively, coincide with each other.

Driving force from the second electric motor M2 is transmitted to the gear G1, which rotates the first photosensitive drum 8A, through the transmission routes L6 and L8. Driving force from the second electric motor M2 is transmitted to the gear G2, which rotates the second photosensitive drum 8B, through the transmission routes L6 and L7.

Transmission routes of driving force to the third photosensitive drum 8C and the fourth photosensitive drum 8D are not illustrated in the drawings. Furthermore, driving force from the second electric motor M2 is transmitted to the gear G9, which rotates the belt 13, through the transmission routes L6 and L9.

The transmission routes L6 to L9 of the driving force from the second electric motor M2 to the gears G1 to G4 and G9 do not pass though the gear 23A. Accordingly, regardless of the state of the gear 23A, that is, regardless of the state of the transmission mechanism 23, the first photosensitive drum 8A to the fourth photosensitive drum 8D and the belt 13 rotate while being interlocked with the rotation of the second electric motor M2.

The second electric motor M2 is disposed below the gears G1 to G4, in other words, the second electric motor M2 is disposed below the plane S0. The second electric motor M2 is disposed between the gear G1 and the gear G4 in the front-rear direction. More specifically, the center of the second electric motor M2 is disposed between the gear G2 and the gear G3 in the front-rear direction.

Accordingly, the plurality of gears that constitute the transmission routes L6 to L8 can be disposed easily. Furthermore, as the second electric motor M2 is disposed in the lower portion of the main body, an adverse effect brought about by vibration caused by rotation of the second electric motor M2 can be reduced. Furthermore, as the second electric motor M2 is disposed near the middle of the main body in the front-rear direction, an adverse effect brought about by vibration caused by rotation of the second electric motor M2 can be reduced.

A connecting mechanism 25 mechanically connects the moving mechanism 21 and the transmission mechanism 23 to move them together. Specifically, when the second to fourth developing rollers 6B to 6D are in the development positions, the connecting mechanism 25 brings the transmission mechanism 23 into the transmission state, and when the second to fourth developing rollers 6B to 6D are in the retracted positions, the connecting mechanism 25 brings the transmission mechanism 23 into the cut-off state.

As illustrated in FIG. 5A, the connecting mechanism 25 includes the connection member 25A. The connection member 25A is a strip-shaped link member that extends from above the moving mechanism 21 to near the transmission mechanism 23. In other words, as illustrated in FIG. 6A, the connection member 25A is movably mounted on the main frame 15 and extends from above the upper end of the main frame 15 to near the lower end thereof.

As illustrated in FIG. 5A, a second rack 25B that receives force that moves the connection member 25A (hereinafter, referred to as connection member moving force) is provided in an end portion of the connection member 25A closer to the direct action member 21A. One of the direct action members 21A closer to the connection member 25A is provided with a third rack 21G that receives force that moves the direct action member 21A (hereinafter, referred to as direct-action member moving force).

A transmission route L5 along which the first electric motor M1 transmits a driving force to a pinion 27 is determined by components, such as gears. The components arranged along the transmission route L5 constitute a driving mechanism configured to drive the moving mechanism 21 and the transmission mechanism 23 simultaneously. Specifically, the pinion 27 included in the drive mechanism meshes with the second rack 25B and the third rack 21G. By rotating upon receipt of driving force from the first electric motor M1, the pinion 27 exerts connection member moving force and direct-action member moving force on the connection member 25A and the direct action member 21A, respectively, at the same time. The connecting mechanism 25 receives force from the moving mechanism 21 and mechanically works together with the moving mechanism 21.

The connection member 25A that has received the connection member moving force moves parallel to a direction parallel to the extending direction of the connection member 25A, in other words, the connection member 25A moves parallel to a direction that intersects a moving direction in which the direct action member 21A moves. The end portion of the connection member 25A including the second rack 25B meshing with the pinion 27 is disposed closer to the first photosensitive drum 8A than the end portion of the connection member 25A engaging with the rotation shaft 23B of the gear 23A in a direction in which the photosensitive drums 8 are arranged, that is, in a direction parallel to the moving direction of the stretched surface 13A. In other words, a direction in which the connection member 25A extends is oblique to the moving direction of the direct action member 21A and the vertical direction.

As illustrated in FIG. 4, the pinion 27 is a gear that is an integrated body of a first gear portion 27A that receives driving force from the first electric motor M1, a second gear portion 27B that meshes with the second rack 25B, and a third gear portion (not shown) that meshes with the third rack 21G. The third gear portion is provided on a side of the first gear portion 27A opposite a side thereof on which the second gear portion 27B is provided.

A second clutch 22B that interrupts transmission of driving force to the pinion 27 is provided in the transmission route L5. The second clutch 22B is a solenoid operated interrupter.

In a state in which transmission of driving force to the first developing roller 6A is cut off at the first clutch 22A, driving force from the first electric motor M1 is transmitted to the pinion 27 through the second clutch 22B. Thus, the direct action member 21A and the connection member 25A operate.

For the monochrome printing mode, the first electric motor M1 is caused to rotate in one direction such that the direct action member 21A moves to one side in its moving direction and the connection member 25A moves to one side in its moving direction. Thus, the second to fourth developing rollers 6B to 6D are separated from the second to fourth photosensitive drums 8B to 8D, respectively, and located in the retracted positions, and the gear 23A is separated from the output gear 23D such that the transmission mechanism 23 is in the cut-off state.

For the color printing mode, the first electric motor M1 is caused to rotate in the other direction such that the direct action member 21A moves to the other side in its moving direction and the connection member 25A moves to the other side in its moving direction. Thus, the second to fourth developing rollers 6B to 6D are brought into contact with the second to fourth photosensitive drums 8B to 8D, respectively, and located in the development positions, and the gear 23A meshes with the output gear 23D such that the transmission mechanism 23 is in the transmission state.

In this manner, switching between the monochrome printing mode and the color printing mode can be performed.

In a state in which the transmission of driving force to the pinion 27 is cut off at the second clutch 22B, driving force from the first electric motor M1 is transmitted to the first developing roller 6A through the first clutch 22A.

When monochrome printing or color printing is performed, the positions of the direct action member 21A and the connection member 25A are maintained by a rotational resistance of the gear train included in the transmission routes, a rotational resistance between the pinion 27 and each of the second rack 25B and third rack 21G, a frictional force acting on the direct action member 21A and the connection member 25A themselves, and others.

In the present embodiment, the moving mechanism 21 and the transmission mechanism 23 are independently provided. This allows a high degree of flexibility in design.

In the present embodiment, the rotating shaft 23B of the gear 23A moves between the transmission state and the cut-off state. Thus, the transmission mechanism 23 can interrupt transmission of driving force easily.

In the present embodiment, the connecting mechanism 25 includes the connection member 25A constituted by a single member that extends from the moving mechanism 21 to the transmission mechanism 23. Accordingly, the connecting mechanism 25 can move the moving mechanism 21 and the transmission mechanism 23 in a precise and accurate manner with a fewer number of components compared with a case where a gear train including a plurality of gears is used.

In the present embodiment, the pinion 27 is provided that meshes with the third rack 21G provided in the direct action member 21A and the second rack 25B provided in the connection member 25A. Accordingly, the connecting mechanism 25 and the moving mechanism 21 can be interlocked through the pinion 27.

In the present embodiment, force is transmitted from the pinion 27 to the direct action member 21A and the connection member 25A. Thus, the connecting mechanism 25 and the moving mechanism 21 are configured to receive the force from the pinion 27. Accordingly, the operating time difference between the connecting mechanism 25 and the moving mechanism 21 can be made small.

In the present embodiment, during monochrome printing, the rotation of the second to fourth developing rollers 6B to 6D is stopped. With this structure, color developers such as magenta, cyan, and yellow are not subjected to any pressure from the blade 6F and others during monochrome printing. Accordingly, the color developers can be prevented from being damaged early.

In the disclosure, interlocking with the stoppage of the rotation of the second to fourth developing rollers 6B to 6D, the second to fourth developing rollers 6B to 6D can be separated from the second to photosensitive drums 8B to 8D, respectively. Accordingly, even while the rotations of the second to fourth developing rollers 6B to 6D are stopped, the second to fourth photosensitive drums 8B to 8D can be caused to rotate.

The above embodiment shows, but is not limited to a direct transfer type image forming apparatus which directly transfers developers onto a sheet transported by a belt 13. The disclosure may be applied to an intermediate transfer type image forming apparatus which, after transferring a developer image to a belt 13, transfers the developer image that has been transferred to the belt 13 onto a sheet.

The above embodiment shows, but is not limited to, that the first electric motor M1 generates driving force that rotates the first developing roller 6A and the second electric motor M2 generates driving force that rotates the second to fourth developing rollers 6B to 6D. The he second electric motor M2 may generate driving force that rotates the first developing roller 6A and the second to fourth developing rollers 6B to 6D.

The above embodiment shows, but is not limited to, that the second to fourth developing rollers 6B to 6D are in contact with the second to fourth photosensitive drums 8B to 8D, respectively, when in the development positions, and the second to fourth developing rollers 6B to 6D are separated from the second to photosensitive drums 8B to 8D, respectively, when in the retracted positions. The second to fourth photosensitive drums 8B to 8D may be separated from the belt 13 while the second to fourth developing rollers 6B to 6D are in contact with the second to fourth photosensitive drums 8B to 8D, respectively, when in the retracted positions.

The above embodiment shows, but is not limited to, the image forming apparatus in which the sheet is transported in the horizontal direction. The disclosure may be applied to an image forming apparatus in which the sheet is transported in the vertical direction.

The above embodiment shows, but is not limited to, that force is input to the moving mechanism 21 (the direct action member 21A) and the connecting mechanism 25 (the connection member 25A) through the pinion 27. The force may be input to the direct action member 21A and, then, the input force may be input to the connection member 25A through the pinion 27. The force may be input to the connection member 25A and, then, the input force may be input to the direct action member 21A through the pinion 27.

The above embodiment shows, but is not limited to, that the direct action member 21A of the moving mechanism 21 and the connection member 25A of the connecting mechanism 25 move parallel to the direction in which they extend.

The above embodiment shows, but is not limited to, that the connection member 25A is a strip-shaped member that extends in the direction that intersects both the direction in which the direct action member 21A extends and the vertical direction.

While the features herein have been described in connection with various example structures and illustrative aspects, it will be understood by those skilled in the art that other variations and modifications of the structures and aspects described above may be made without departing from the scope of the inventions described herein. Other structures and aspects will be apparent to those skilled in the art from a consideration of the specification or practice of the features disclosed herein. It is intended that the specification and the described examples only are illustrative with the true scope of the inventions being defined by the following claims.

What is claimed is:

1. An image forming apparatus configured to form an image on a sheet, comprising:

a first photosensitive drum having a rotation axis and configured to carry a developer image thereon;

a second photosensitive drum having a rotation axis parallel to the rotation axis of the first photosensitive drum and configured to carry a developer image thereon;

a first developing roller configured to supply a first developer to the first photosensitive drum;

a second developing roller configured to supply a second developer to the second photosensitive drum, the second developing roller being configured to move between a development position in which the second developing roller supplies the second developer to the second photosensitive drum and a retracted position in which the second developing roller stops supplying the second developer to the second photosensitive drum, the second developing roller configured to rotate about a rotation axis, the rotation axis of the second developing roller extending in a longitudinal direction, the second developing roller having a first end and a second end, the second end being opposite to the first end in the longitudinal direction;

an electric motor configured to generate a driving force to cause the second developing roller to rotate;

a moving mechanism disposed on a same side as the rotation axis of the second developing roller relative to a plane intersecting and parallel to both of the rotation axis of the first photosensitive drum and the rotation axis of the second photosensitive drum, the moving mechanism being configured to move the second developing roller between the development position and the retracted position;

a transmission mechanism and the rotation axis of the second developing roller being disposed on opposite sides of the plane, the transmission mechanism being configured to transmit the driving force to the second developing roller, and to change between a transmission state that allows transmission of the driving force to the second developing roller and a cut-off state that cuts off transmission of the driving force to the second developing roller;

a drive mechanism configured to drive the moving mechanism and the transmission mechanism simultaneously; and a connecting mechanism configured to connect the moving mechanism and the transmission mechanism, the connecting mechanism being configured to when the second developing roller is in the development position, move the transmission mechanism into the transmission state in a first movement direction, and when the second developing roller is in the retracted position, move the transmission mechanism into the cut-off state in a second movement direction, the first and second movement directions each having at least a respective component direction orthogonal to the plane, wherein each of the moving mechanism, the transmission mechanism and the connecting mechanism are disposed closer to the first end of the second developing roller, in a direction of the rotation axis of the second developing roller, than to the second end of the second developing roller.

2. The image forming apparatus according to claim 1, further comprising an endless belt disposed in a position facing the first photosensitive drum and the second photosensitive drum and on a same side as the transmission mechanism relative to the plane, wherein the electric motor is disposed on a same side of the plane as the endless belt.

3. The image forming apparatus according to claim 2, wherein the endless belt is configured to receive force from the electric motor and rotate.

4. The image forming apparatus according to claim 1, further comprising a developer storage portion configured to store the second developer supplied by the second developing roller, wherein the developer storage portion is disposed between the moving mechanism and the second photosensitive drum in a direction orthogonal to the plane.

5. The image forming apparatus according to claim 1, wherein the transmission mechanism includes a gear having a rotating shaft, the gear and the rotating shaft configured to integrally move in the first and second movement directions in correspondence with the transmission mechanism changing between the transmission state and the cut-off state, respectively.

6. The image forming apparatus according to claim 1, further comprising:

a third photosensitive drum disposed parallel to the first photosensitive drum and the second photosensitive drum, the third photosensitive drum being configured to carry a developer image; and a third developing roller configured to supply a third developer to the third photosensitive drum, the third developing roller being configured to move between a development position in which the third developing roller supplies the third developer to the third photosensitive drum and a retracted position in which the third developing roller stops supplying the third developer to the third photosensitive drum, wherein the moving mechanism is configured to move the second developing roller and the third developing roller at the same time.

7. The image forming apparatus according to claim 1, wherein the connecting mechanism is configured to operate with force received from the moving mechanism.

8. The image forming apparatus according to claim 1, wherein the connecting mechanism includes a connection member extending from near the moving mechanism to the transmission mechanism.

9. The image forming apparatus according to claim 8, wherein the moving mechanism includes a direct action member configured to move in a direction parallel to a direction in which the first photosensitive drum and the second photosensitive drum are arranged, and the direct action member includes a rack, wherein the connection member of the connecting mechanism includes a rack, wherein the drive mechanism includes a pinion configured to engage the rack of the direct action member of the moving mechanism and the rack of the connection member of the connecting mechanism, and wherein the connection member of the connecting mechanism is configured to move in the first and second movement directions, the first and second movement directions crossing the direction in which the direct action member of the moving mechanism moves.

10. The image forming apparatus according to claim 9, wherein the driving mechanism is configured to transmit a driving force to the pinion.

11. The image forming apparatus according to claim 9, wherein the pinion is disposed closer to the first photosensitive drum, in the direction in which the first photosensitive drum and the second photosensitive drum are arranged, than to the transmission mechanism.

12. The image forming apparatus according to claim 8, wherein the moving mechanism and the transmission mechanism are disposed on opposite sides of the plane, the plane including the axis of the first photosensitive drum and the axis of the second photosensitive drum.

13. The image forming apparatus according to claim 1, wherein the first developer is black developer and the second developer is color developer except for black.

14. The image forming apparatus according to claim 1, wherein the second photosensitive drum is configured to receive force from the electric motor and rotate.

15. The image forming apparatus according to claim 1, wherein the moving mechanism, the transmission mechanism and the connecting mechanism are separable from one another, and wherein the moving mechanism is spaced apart from the transmission mechanism in a direction orthogonal to the plane.

16. The image forming apparatus according to claim 1, wherein the connecting mechanism is configured to move in the first and second movement directions.

17. An image forming apparatus configured to form an image on a sheet, comprising:

a first photosensitive drum configured to rotate about a rotation axis and configured to carry a developer image thereon;

a second photosensitive drum configured to rotate about a rotation axis parallel to the rotation axis of the first photosensitive drum and configured to carry a developer image thereon;

a first developing roller configured to rotate about a rotation axis and supply a first developer to the first photosensitive drum;

a second developing roller configured to rotate about a rotation axis and supply a second developer to the second photosensitive drum, the second developing roller being configured to move between a development position in which the second developing roller supplies the second developer to the second photosensitive drum and a retracted position in which the second developing roller stops supplying the second developer to the second photosensitive drum;

an electric motor configured to generate a driving force to cause the second developing roller to rotate;

a moving mechanism disposed above the second developing roller, the moving mechanism being configured to move the second developing roller between the development position and the retracted position;

a transmission mechanism including at least one transmission gear disposed below the second developing roller, the transmission mechanism being configured to transmit the driving force to the second developing roller, the transmission mechanism, including the at least one transmission gear, being configured to move, relative to the first and second developing rollers, between a transmission state that allows transmission of the driving force to the second developing roller and a cut-off state that cuts off transmission of the driving force to the second developing roller;

a drive mechanism configured to drive the moving mechanism and the transmission mechanism simultaneously; and a connecting mechanism configured to connect the moving mechanism and the transmission mechanism, the connecting mechanism being configured to, when the second developing roller is in the development position, bring the transmission mechanism into the transmission state, the connecting mechanism being configured to, when the second developing roller is in the retracted position, bring the transmission mechanism into the cut-off state, wherein each of the moving mechanism, the transmission mechanism and the connecting mechanism are disposed closer to a same first longitudinal end of the second developing roller, in a direction of the rotation axis, than to a second longitudinal end of the second developing roller.

18. The image forming apparatus according to claim 17, wherein the drive mechanism includes a driving force transmitting element configured to transmit a driving force to the moving mechanism and the connecting mechanism simultaneously.

19. The image forming apparatus according to claim 18, wherein the connecting mechanism is configured to transmit the driving force to the transmission mechanism.

20. The image forming apparatus according to claim 18, wherein the drive mechanism includes a driving source configured to generate the driving force transmitted to the driving force transmitting element.

* * * * *